US005547175A

United States Patent [19]

Graushar et al.

[11] Patent Number: 5,547,175

[45] Date of Patent: Aug. 20, 1996

[54] APPARATUS AND METHOD FOR PREPARING MAIL PRODUCTS

[75] Inventors: William T. Graushar, Wauwatosa; Todd J. Dettmering, Menomonee Falls, both of Wis.

[73] Assignee: Quad/Tech, Inc., Pewaukee, Wis.

[21] Appl. No.: 39,922

[22] Filed: Mar. 29, 1993

[51] Int. Cl.[6] ..... B41L 43/12; B42C 1/00

[52] U.S. Cl. ..... 270/037; 270/45; 270/1.03; 53/136.3

[58] Field of Search ..... 270/37, 45, 51, 270/54, 58; 53/415, 135.1, 136.1, 136.3

[56] References Cited

U.S. PATENT DOCUMENTS

| | | | |
|---|---|---|---|
| 3,917,252 | 11/1975 | Harder et al. | 270/58 |
| 3,983,679 | 10/1976 | Zemke | 53/415 X |
| 4,121,818 | 10/1978 | Riley et al. | 270/54 |
| 4,160,687 | 7/1979 | Spear | 156/444 |
| 4,167,476 | 9/1979 | Jackson | 270/58 X |
| 4,674,052 | 6/1987 | Wong et al. | 270/54 X |
| 4,790,119 | 12/1988 | McDaniels | 53/411 |
| 4,800,505 | 1/1989 | Axelrod et al. | 270/58 X |
| 4,800,506 | 1/1989 | Axelrod et al. | 270/58 X |
| 5,013,019 | 5/1991 | Samuels | 270/54 X |
| 5,028,192 | 7/1991 | Lindsay et al. | 270/54 X |
| 5,048,809 | 9/1991 | Tebbe et al. . | |
| 5,054,757 | 10/1991 | Martin et al. | 270/45 |
| 5,114,128 | 5/1992 | Harris, Jr. et al. | 270/54 X |
| 5,183,246 | 2/1993 | Edwards et al. | 270/45 |
| 5,185,983 | 2/1993 | Slater | 53/136.3 |

FOREIGN PATENT DOCUMENTS

| | | | |
|---|---|---|---|
| 019606 | 5/1980 | European Pat. Off. | 270/53 |
| 540816 | 10/1973 | Switzerland | 270/53 |

*Primary Examiner*—John E. Ryznic
*Attorney, Agent, or Firm*—Michael, Best & Friedrich

[57] ABSTRACT

A system for preparing mail products demographically delivered to a conveyor line according to subscriber information includes an arrangement for folding each of the mail products at least once, externally applying a self-adhesive label around each of the mail products after each of the mail products has been folded, and printing customized and address information on each of the mail products before and after folding, respectively.

8 Claims, 2 Drawing Sheets

APPARATUS AND METHOD FOR PREPARING MAIL PRODUCTS

TECHNICAL FIELD

The present invention relates generally to an apparatus and method for preparing mail and, more particularly, to an apparatus and method for forming, sealing and customizing mail products demographically delivered on a conveyor line.

BACKGROUND OF THE INVENTION

The swelling increase in the volume of business mail and the ascendingly high expenditures involved in the preparation and handling of such mail prior to actual distribution require circumvention of manual preparation and handling practices. It is understandable that automation of such practices has virtually become a universally desired objective for all mail enterprises regardless of mail volume.

Automatically controlled preparation of mail for these purposes has been developing toward a reformation of the letter-like item and away from the commonly manufactured envelope filled with enclosures. Envelope-like items are being manufactured, often together with corresponding enclosures, by automatic practices ranging from raw, unprinted sheet matter to finished, product-of press ready for mailing. Such practices may include preprinting of the sheet material, folding, bonding, sealing and perforating for effortless opening of the envelope-like item by the addressee or recipient.

Prior art machinery for the folding and sealing of single, preprinted sheets into mailable letter-like objects, known as self-mailers, includes a system disclosed in U.S. Pat. No. 5,048,809 issued Sep. 17, 1991 to Tebbe, et al. In this arrangement, a sheet folding and sealing apparatus includes a feed mechanism for seriatim feed of sheets along a feed-and-fold path while continuous beads of adhesive are applied along lateral edges of each sheet by a first adhesive applicator. The sheets are fed to a buckle feeding mechanism for forming one or more transverse folds in the sheets while transversely-spaced spots of adhesive are applied by a second adhesive applicator to transverse edges or a transverse fold that abuts a fold pan stop. The folding mechanism has its input and output on one side of the folder and first and second fold pans on the opposite side. The folder also includes folding and sealing rolls that mutually bond and seal folded-over portions of the transversely-folded sheets to close and seal the sheet into a letter-like object. The letter-like objects are then perforated so that tearing along perforation lines removes strips of material which include the adhesively-bonded regions to facilitate opening.

While the above-described structure purports to provide a compact, high speed folding and sealing apparatus with a minimum of components, its construction continues to be less than desirable because of the inherent dispensing of liquid adhesive which occasionally presents problems of dispenser clogging, dripping or insufficient adhesive, and undesirable streaking, smearing or trailing of glue along the sheet surfaces. Such difficulties have resulted in the mutual sticking of the letter-like objects or self-mailers during stacking and subsequent handling and can require costly downtime and replacement of the attendant mail preparation equipment.

Prior art systems of the type described above, are also disadvantageous because of their inflexibility. For example, even though the prior art discloses a method for sheet folding and sealing to produce letter-like objects from single sheets of preprinted material, there is no provision of computer-controlled production of demographically sorted, customized mail products. This flexibility is important in satisfying the demands of a particular market or geographical destination. For instance, it may be desirable to offer certain recipients or readers various features of selected advertising depending upon their special interests, income or occupation. Likewise, it may be relevant to customize products or services contingent upon a reader's previous history. For instance, one reader may receive a brochure advertising a business seminar for improving writing skills for secretaries, while that reader's neighbor may receive a different brochure advertising the basics of discrimination law. In each situation, the seminar sponsor may choose to provide customized information on the mail product before it is folded and sealed.

In addition, it is desirable that mail products be processed in order to take maximum advantage of postal discounts. For example, substantial discounts are offered by the U.S. Postal Service for bar coding letter mail. A first-class letter that is properly bar coded and presorted qualifies for a 5.7 cent per piece discount. A third-class letter meeting the same qualifications can earn 5.2 cent per piece discount or a 3 cent per piece discount for non-profit third-class letters. Accordingly, it is preferable that a system process mail products in an order that facilitates presorting and packaging to optimize postal discounts. In this regard, it would be advantageous in some instances if a plurality of mail products could be assembled and customized during a given production run to facilitate grouping the various mail products destined for a given carrier route. Therefore, it is desirable that current mail preparation systems offer a greater degree of customization improving upon the sortation of the mail products to be customized and permit various mail products to be processed during a single production run for readers in a given postal zone irrespective of varying points of customization.

SUMMARY OF THE INVENTION

The present invention advantageously provides an improved customizing and demographic sorting capability for mail preparation systems. The improved system is particularly versatile and can be retrofit to certain existing systems.

These and other advantages are realized, in one aspect of the invention by a mail preparation system of the type having a plurality of feeders for delivering mail products on a conveyor according to subscriber information, the system including a customizing mechanism connected to the conveyor for effecting a customizing operation on the mail products, a forming mechanism connected with the conveyor for folding the mail products into folded portions, and a tabbing mechanism connected with the conveyor for externally sealing the mail products once the mail products have been folded.

In a highly preferred embodiment, the invention contemplates a printer for applying an address and bar code on each of the mail products according to subscriber information, a folder for providing at least one fold in each of the mail products, and a tabber for applying a self-adhesive label around each of the mail products once the mail products have been folded.

The invention also relates to a method for preparing mail products being delivered on a conveyor line, the method including the steps of folding each of the mail products at least once, externally applying a self-adhesive label around each of the mail products after each of the mail products have been folded to close each of the mail products, and printing address information on each of the mail products after each of the mail products has been closed.

BRIEF DESCRIPTION OF THE DRAWING

The invention will be better understood by referring to the following detailed desription of the preferred exemplary embodiment when read in conjunction with the appended drawing wherein like numerals denote like elements and.

DETAILED DESCRIPTION OF THE PREFERRED EMBODIMENT

Figure 1:
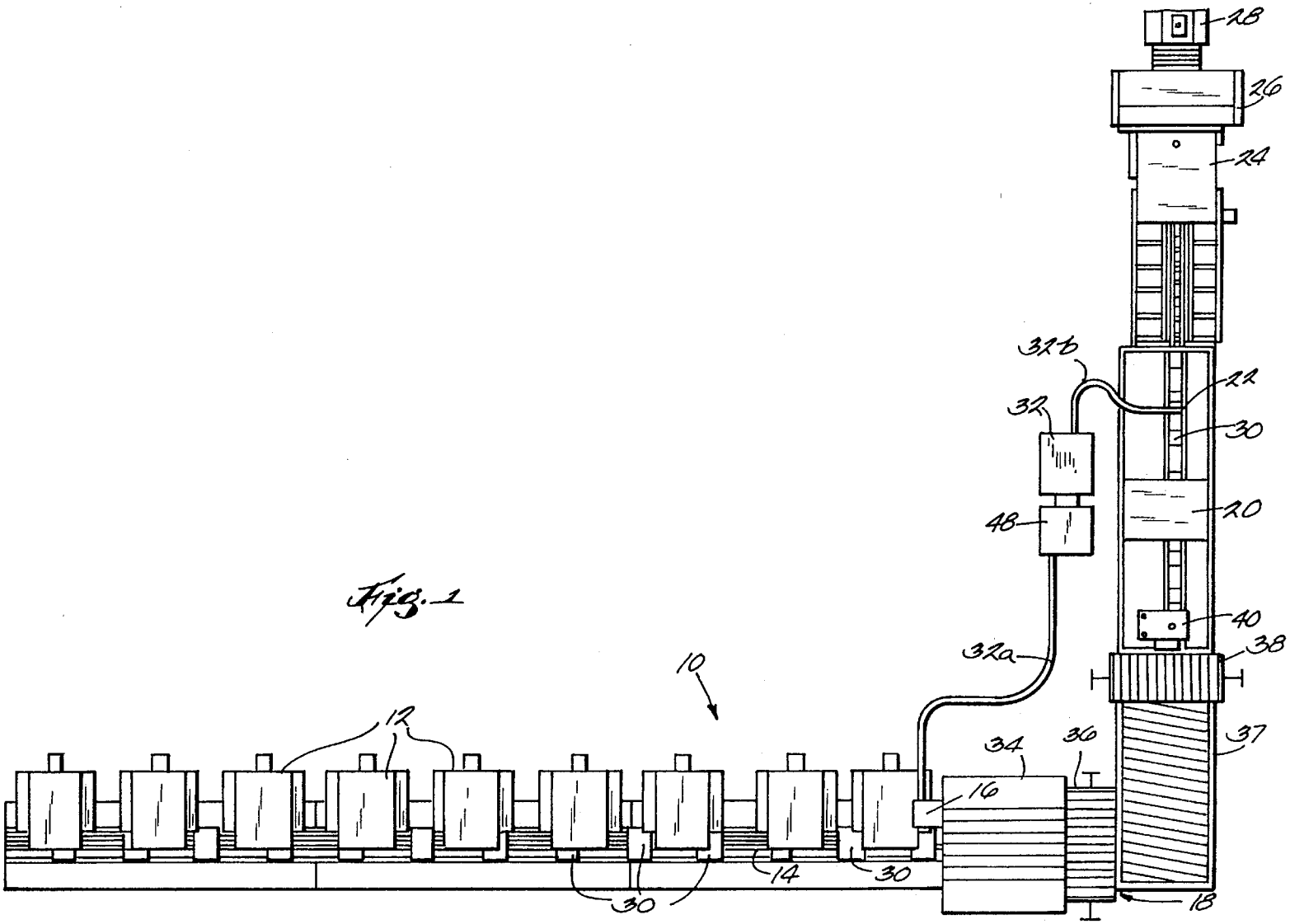
FIG. 1 is a schematic plan view of a mail preparation system employing the present invention.

Referring to FIG. 1, a processing line 10 for a mail preparation system encompassed by the present invention is employed to produce various brochures, newletters, self-mailers, etc. containing different collections of preprinted signatures or sheets for different readers or recipients. Line 10 suitably includes a plurality of feeders 12, a flat belt conveyor line 14, a customizing station 16, a forming station 18, a tabbing station 20, a printing(addressing) station 22, a stacker 24, and a strapper 26 as well as a package conveyor 28 for delivering the processed mail to a further distribution point.

Figure 3:
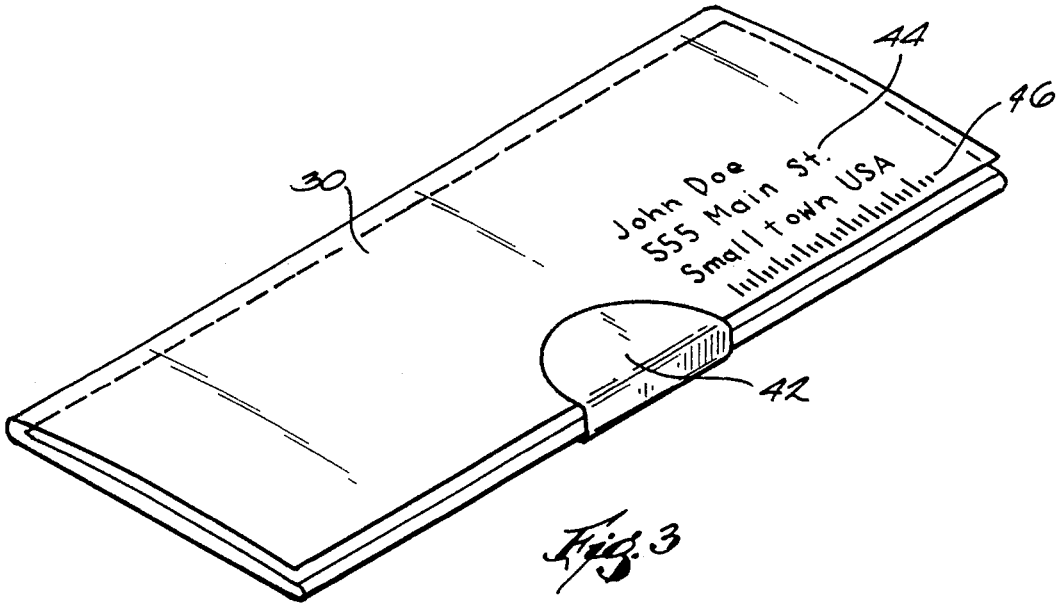
FIG. 3 is a schematic perspective of a completed mail product prepared in the system of FIG. 1.

Each feeder 12 holds a supply of singular sheet or multiple sheet mail products 30 and is designed to deliver a singular sheet or multiple sheet assembly from a supply stack within the feeder 12 so that product 30 falls upon flat, collating conveyor 14 with a transverse edge or the folded margin(spine) leading, although other orientations may be acceptable. Collating conveyor 14 collects mail products 30 from feeders 12 and transports mail products 30 downstream for processing along line 10. As mail products 30 are distributed onto conveyor 14, they are moved towards customizing station 16, ultimately connected to an ink jet printer 32 by a line **32*a* so that personalized information P is applied to mail products 30 being transported in a direction perpendicular to their spines or leading edge. After customizing, conveyor 14 pushes mail products 30 to forming station 18 at which mail products 30 are folded at least once. In the preferred embodiment, forming station 18 is comprised of a conventional buckle folder such as a model TF56/TF66 manufactured by Stahl Gmbh & Co. of Austrasse, Germany. Such buckle folders typically comprise a conveyor unit 34 for transferring mail product 30 and a folding unit 36 for forming a first fold in each mail product 30 and which can be used to provide trimming, scoring and perforating of mail product 30. Another conveyor unit 37 transfers once-folded mail product 30 into a corresponding folding unit 38 for providing a second fold in each mail product 30. In the preferred embodiment, mail product 30, as shown in FIG. 3, is a twice-folded product having its folds spaced apart by about one-third of the length of mail product 30**. This particular folding is a so-called "C-fold" or "letter fold."

Figure 2:
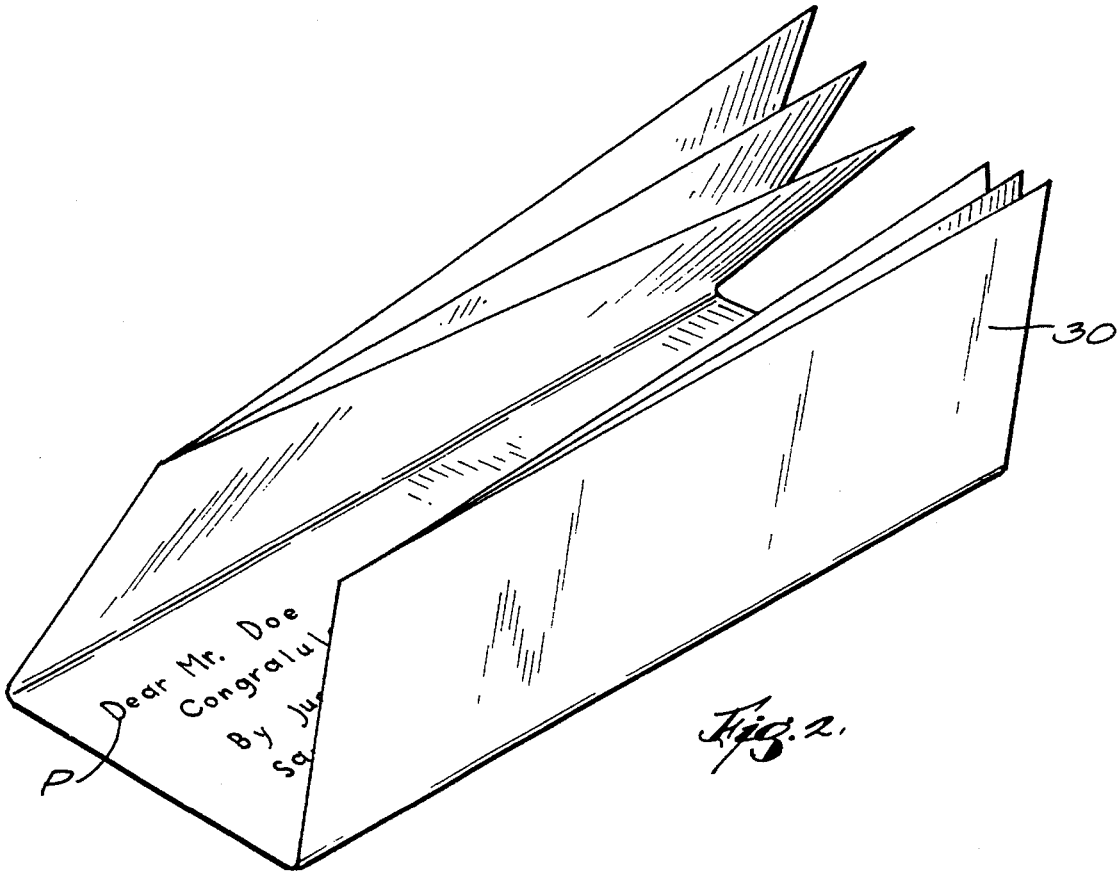
FIG. 2 is a schematic perspective view of a mail product being processed in the system of FIG. 1 depicting the completion of customizing and folding steps.

Following the initial folding and customizing, sequentially depicted in FIG. 2, mail product 30 is rotated ninety degrees by conventional bump turn mechanism 40 and is conveyed to tabbing station 20. Here, a self-adhesive tab or wafer seal 42 is applied externally around each of mail products 30 to close and seal each mail product 30. Tabbing station 20 is a conventional tabber such as normally sold by Fisher Technologies of Cedar Rapids, Iowa, and is generally of the type discosed in U.S. Pat. No. 4,160,687 issued Jul. 10, 1979 to Spear, the structure of which is herein incorporated by reference. Subsequent to the tabbing operation just described, customized, folded and sealed mail product 30 is conveyed to printing station 22 where an address 44 and bar code 46 of the recipient is printed thereon via a line **32*b* in accordance with subscriber information from a programmable computer 48 connected to printer 32. Once this is done, completely finished mail product 30 is then delivered to stacker 24, strapper 26, and finally package conveyor 28**.

Line 10 generally described above is controlled by controller 48, the details of which are known in the art. Likewise feeders 12, customizing station 16, forming station 18, tabbing station 20, printing station 22, stacker 24, strapper 26, and package conveyor 28 are of conventional construction and do not warrant a detailed description.

It should be recognized that the present invention greatly enhances the flexibility of customizing mail products in a mail preparation system and allows mail products having different types of customization to be processed for recipients in given postal zone with optimal postal discounts. Unlike prior art systems which contemplate folding and sealing of single sheets only without demographic sorting and by means of problematical liquid adhesives, the present invention provides improved productivity by utilizing bar coding, dry adhesive sealing, and optimal sortation.

While the invention has been described with reference to a preferred embodiment, those skilled in the art will appreciate that certain substitutions, alterations and omissions may be made without departing from the spirit thereof. For example, while the preferred form of the invention dicloses a two unit buckle folder for making a "C-fold", it should be appreciated that a one unit buckle folder could be employed to produce a "V-fold" or half-folded mail product. Other folded configurations may be provided as desired. Likewise, any number of self-adhesive labels could be applied to close each mail product. Accordingly, the foregoing description is meant to be exemplary only and should not be deemed limitative on the scope of the invention set forth in the following claims.

I claim:

1. A system for preparing mail products, said system comprising:

controller means cooperating with a source of individualized subscriber information for generating control signals in accordance with said individualized subscriber information;

conveyor means for transporting said mail products;

feeder means responsive to control signals from said controller means for demographically delivering mail products to said conveyor means so that the mail products are individualized according to said individualized subscriber information;

customizing means operatively connected with said conveyor means for effecting a customizing operation on said mail products, said customizing means including first printing means located adjacent said feeder means and downstream thereof for applying customized information on said mail products being delivered on said conveyor means, and said customizing means including second printing means for applying mailing information on said mail products;

forming means operatively connected with said conveyor means for folding said mail products into folded portions, said forming means being positioned downstream of said first printing means and upstream of said second printing means, and said forming means having at least one fold unit for effecting at least one fold in each of said mail products; and tabbing means operatively connected with said conveyor means for externally sealing said mail products once said mail products have been folded.

2. The system of claim 1, including stacking means located on said conveyor means for sorting said mail products according to said individualized subscriber information.

3. The system of claim 1, wherein said mailing information is in the form of a bar code representing demographic and zip code information.

4. The system of claim 1, wherein said mailing information is in the form of a printed address.

5. The system of claim 1, wherein said tabbing means comprises an apparatus for applying self-adhesive tabs around said folded portions of said mail products after said mail products have been folded to hold said mail products closed.

6. A mail product preparation system comprising:

programmable control means for generating control signals in accordance with individualized subscriber information;

a conveyor line;

means controlled by said programmable control means for demographically sorting signatures according to said individualized subscriber information, said means for demographically sorting including a plurality of feeders for delivering signatures on said conveyor line, said plurality of feeders being controlled by said programmable control means so that the signatures are delivered to said conveyor line according to said individualized subscriber information;

means located downstream of said plurality of feeders for customizing the signatures, said means for customizing the signatures being controlled by said programmable control means in accordance with said individualized subscriber information;

a folder located downstream of said means for customizing the signatures, said folder having at least one fold unit for providing at least one fold in each of the signatures to form mail products;

a tabber located downstream of said folder, said tabber being adapted to apply a tab around each of said mail products after each of said mail products has been folded to close each of said mail products; and a printer operatively connected with said tabber and with said programmable control means, said printer applying an address and bar code on each of said mail product according to said individualized subscriber information.

7. A method for preparing mail products in a system of the type having a conveyor line and a plurality of feeders for delivering signatures to said conveyor line according to individualized subscriber information, said method comprising the steps of:

providing a programmable control means for generating signals according to said individualized subscriber information;

delivering signatures to the conveyor line in accordance with the signals generated by the programmable control means so that the signatures are demographically sorted according to said individualized subscriber information;

customizing at least selected ones of the demographically sorted signatures;

folding individual collections of signatures to form mail products after the selected ones of the signatures in each collection are customized;

externally applying a tab around each of said mail products after each of said mail products has been folded to close each of said mail products; and printing address information on each of said mail products after each of said mail products has been closed.

8. The method of claim 7, including the step of sorting said mail products after each of said mail products has been folded, closed and printed with address information.

* * * * *